United States Patent [19]

Cunningham et al.

[11] Patent Number: 4,610,195

[45] Date of Patent: Sep. 9, 1986

[54] PISTON FOR A HYDRAULIC PISTON MACHINE OF THE MULTIPLE DISPLACEMENT TYPE

[75] Inventors: Sinclair Cunningham, Kinghorn, Scotland; Peter Wüsthof, Lohr, Fed. Rep. of Germany

[73] Assignee: Mannesmann Rexroth GmbH, Lohr, Fed. Rep. of Germany

[21] Appl. No.: 752,725

[22] Filed: Jul. 8, 1985

[30] Foreign Application Priority Data

Jul. 6, 1984 [DE] Fed. Rep. of Germany ..... 3425015
Aug. 25, 1984 [DE] Fed. Rep. of Germany ..... 3431328

[51] Int. Cl.[4] ..... F01B 13/06

[52] U.S. Cl. ..... 91/488; 91/491; 92/249

[58] Field of Search ..... 91/499, 488; 92/249; 417/269; 74/60

[56] References Cited

U.S. PATENT DOCUMENTS

| | | | |
|---|---|---|---|
| 2,277,496 | 3/1942 | Maines | 74/60 |
| 3,749,523 | 7/1973 | Wahl | 417/269 |
| 3,783,748 | 1/1974 | Cunningham | 91/488 |
| 3,874,275 | 4/1975 | Cunningham | 91/488 |
| 4,043,255 | 8/1977 | Cunningham | 91/488 |
| 4,077,269 | 3/1978 | Hodgkinson | 74/60 |
| 4,465,394 | 8/1984 | Berthold | 91/507 |

*Primary Examiner*—William L. Freeh
*Attorney, Agent, or Firm*—Cushman, Darby & Cushman

[57] ABSTRACT

A piston for a hydraulic piston machine in which a piston body receives a ball in a space defined at one end of thereof. A bearing dish supports the ball in the space with an O-ring engaging the recess to seal the bottom surface of the bearing dish. Preferably the bearing dish is formed with a steel support layer, a bronze layer cast onto the steel support layer, and a plastic layer supporting the ball.

9 Claims, 6 Drawing Figures

PISTON FOR A HYDRAULIC PISTON MACHINE OF THE MULTIPLE DISPLACEMENT TYPE

The invention relates in general to hydraulic piston machines of the multiple displacement type and specifically to a piston for a piston machine of the multiple displacement type. The prospectus RD No. 14250/6.84 of the assignee shows such a hydraulic piston machine of the multiple displacement type. The invention also relates to a method of arranging a ball bearing dish element for the piston of a piston machine of the multiple displacement type, specifically an axial piston machine of this type.

Piston machines of the multiple displacement type can be designed in the form of a hydraulic pump as well as in the form of a hydraulic motor. The piston of such a piston machine of the multiple displacement type (PMMD) has to be supported in a suitable manner so that the pistons of the PMMD can carry out the necessary reciprocal pumping and suction movements. It is already known to provide support for the pistons by means of each one ball which is supported for instance by a swash plate or a similar member. For this purpose, the end of each piston commonly is provided with a ball receiving space, a space in which the ball is located and is supported by the piston. In this connection, see for instance the prospectus RD No. 14250/6.84 of Mannesmann Rexroth Ltd. Jahnstraße 3-5, Lohr (Main), West Germany, the assignee.

So as to provide low friction between the ball and the piston, the invention suggests to provide bearing dish means in said ball receiving space, said bearing dish means being adapted to substantially support said ball. Preferably, said bearing dish means comprises a compound material having steel support means, a bronze layer cast thereon and a plastic material layer, said plastic material layer being adapted to support said ball with low friction.

A particular object of the invention is firstly to seal the bearing dish means at its bottom surface, which preferably is made of steel, with respect to pressure, and secondly, it is intended to hinder the rotation of said bearing dish means due to the drilling action of the ball.

In accordance with this invention, this object is attained by providing an O-ring which is located between said piston and said bearing dish means in an additional recess in the piston. Preferably, said additional recess is located adjacent to a centrally located pressure relief bore.

In accordance with another aspect of the invention, a method is provided to simply and safely locate the bearing dish means. In accordance with this method, the O-ring is inserted in a biased condition into the piston in such a manner that the preformed bearing dish means can be pressed into said piston by means of a stamp-like tool, with the outermost marginal area of said bearing dish means being arranged in an undercut of said piston.

Preferred embodiments of the invention are disclosed in the subclaims.

Additional advantages, objects and details of the invention may be gathered from the description of embodiments in connection with the drawing; in the drawing.

Figure 1:
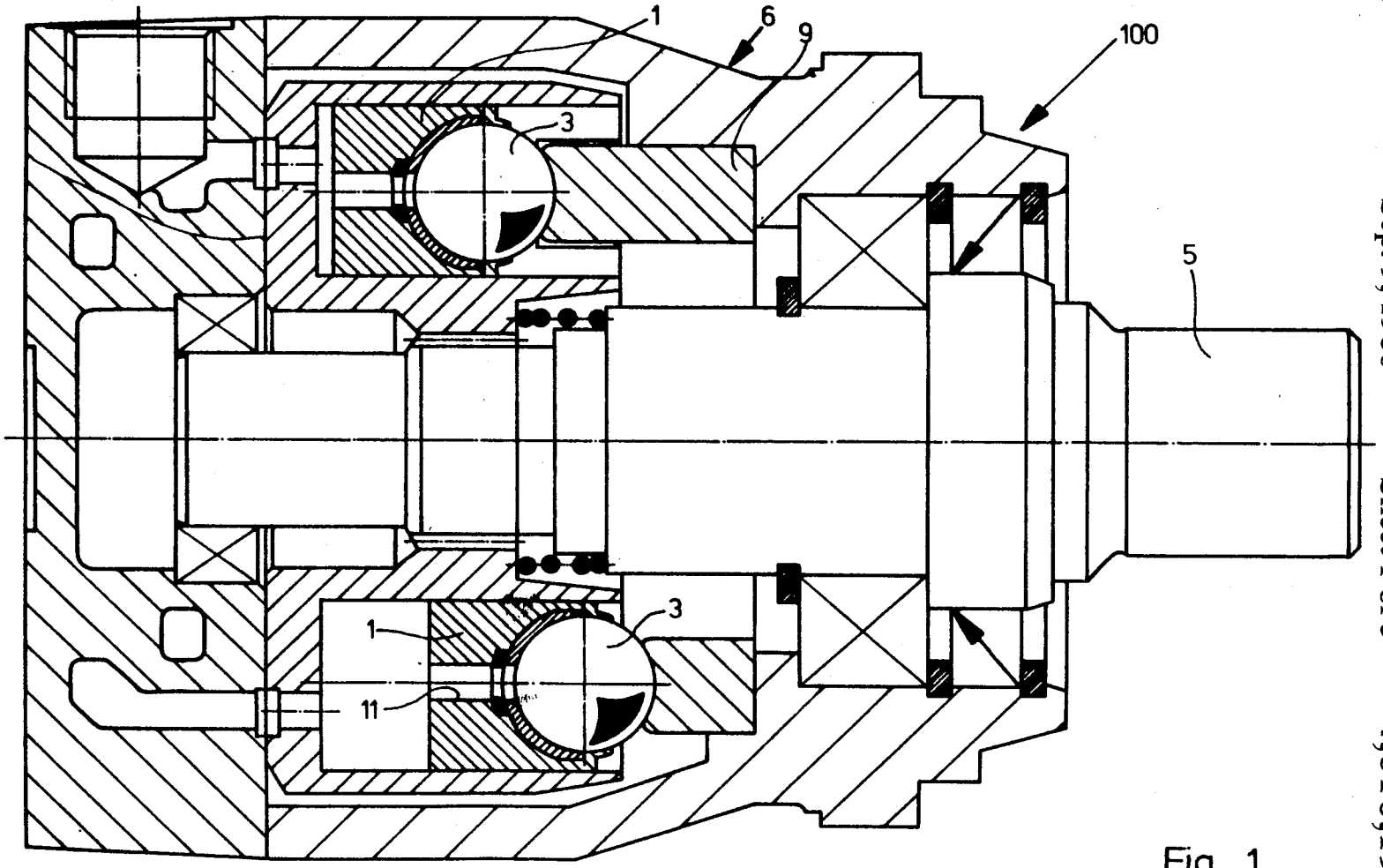
FIG. 1 is a longitudinal section of a piston machine of the multiple displacement type and being provided with the ball bearing means of the invention.
Figure 2:
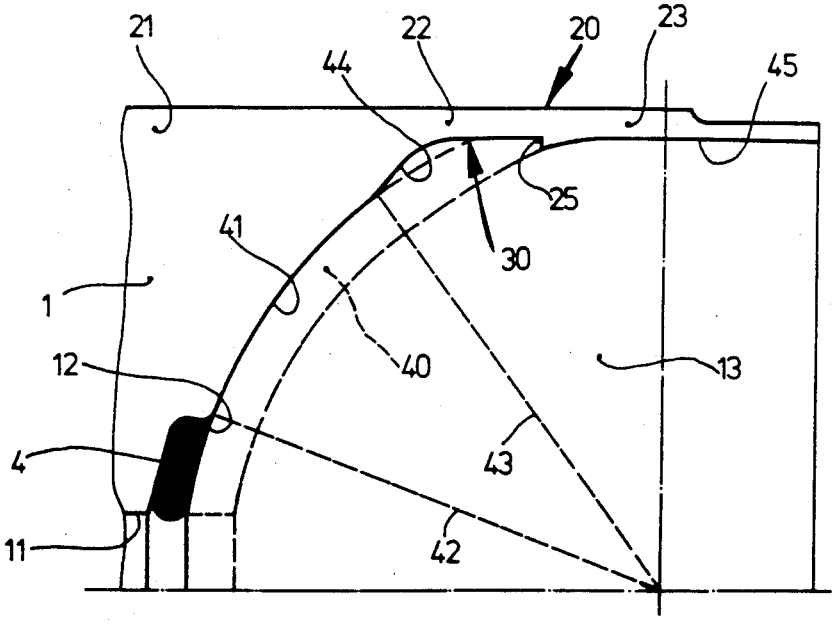
FIG. 2 is a partial longitudinal section of an end of the piston where the ball receiving section is located.
Figure 5:
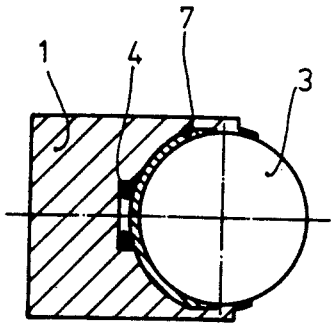
FIG. 5 is a section similar to FIG. 4, but without a pressure relief bore.

In FIG. 1 a hydraulic piston machine of the multiple displacement type (PMMD) 100 is shown, comprising a housing 6 in which a shaft 5 is rotatably supported and cooperates in a well-known manner with pistons 1. Said pistons 1 are supported via balls 3 by means of a body 9 which defines a multi-lobe cam. Each of said pistons comprises a ball receiving space 13 as shown in FIG. 2 and a pressure relief bore 11 which is connected to said ball receiving space 13. FIG. 5 shows a piston design without a pressure relief bore.

Figure 3:
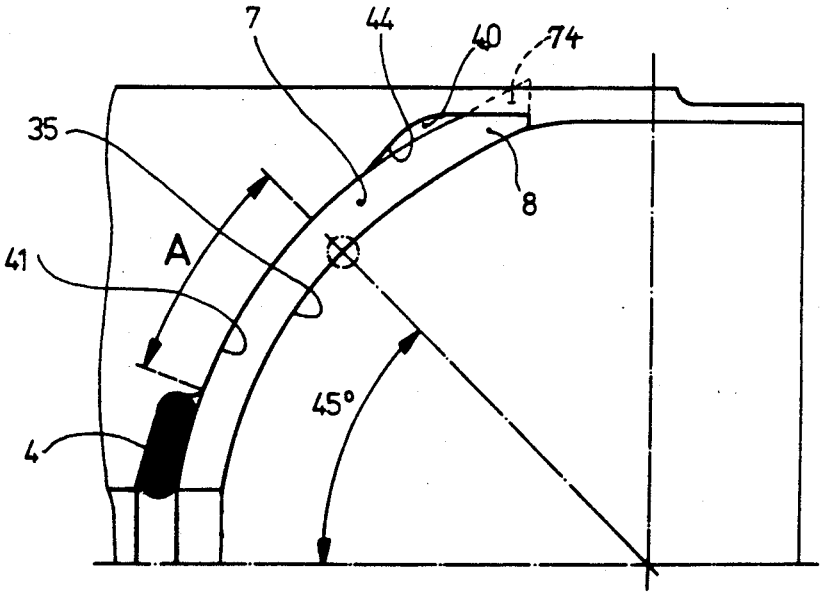
FIG. 3 is a longitudinal section similar to FIG. 2 with the dish bearing means for the ball being inserted into a dish bearing means recess of the ball receiving space.

In accordance with the invention—see FIGS. 2 and 3—the ball receiving space 13 defines an aperture 40 adapted to receive, in accordance with the invention, a bearing dish means 7. The bearing dish means 7 is clearly shown in FIGS. 3, 4 and 5.

Figure 6:
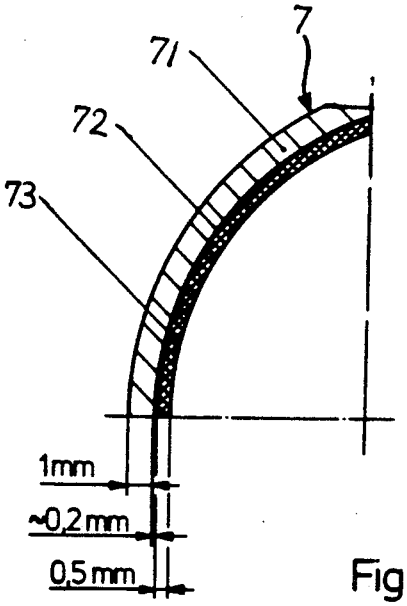
FIG. 6 is a section of a part of bearing dish means of the invention.

FIG. 6 discloses in detail the bearing dish means 7 which consists of a compound material which is known per se. The compound material for the bearing dish means 7 comprises a steel support 71, a bronze layer 72 cast thereon and a layer 73 of plastic material. The ball 3 is supported with low friction on the plastic layer 73.

It is noted that favorable frictional and wear characteristics are obtained for a plastic layer 73 having a thickness of approximately 0.5 mm. Normally, said layer is only 0.1 to 0.2 mm thick. The steel support preferably has a thickness of 1 mm. The thickness of the bronze layer is less than 0.1 mm.

In accordance with the invention an additional aperture 12 is provided adjacent to the central pressure relief bore 11; an O-ring 4 is inserted into said additional aperture 12. For details see FIGS. 2—4. As a consequence of this design, the bearing dish means 7 inserted into the piston (piston body) 1 is sealed at the lower surface with respect to pressure, and further the bearing dish means 7 is hindered to rotate due to the drilling effect of the ball 3. FIG. 5 shows a similarly arranged O-ring 4; however, without the use of the bore 11.

In accordance with the invention the O-ring 4 is biased during the placement of the bearing dish means 7. The bias or prestress of the O-ring 4 is achieved by pressing the preformed bearing dish means 7 by means of a stamp-like tool with the outermost marginal area of said bearing dish means 7 into an undercut 25 of the piston 1.

Figure 4:
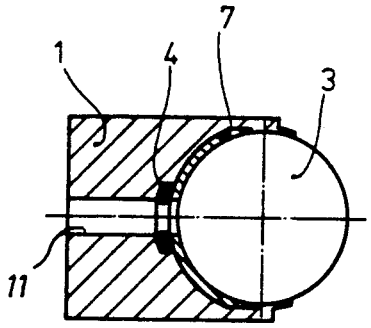
FIG. 4 is a section of a piston of a PMMD, said piston comprising a pressure relief bore and a ball supported therein.

FIGS. 2 and 3 as well as FIGS. 4 and 5 disclose the invention in detail. In FIG. 2 neither the bearing dish means 7 nor the ball 3 are placed in the ball receiving space 13. However, the annular O-seal ring 4 is already located in the appropriate aperture 12, an aperture which is preferably immediately adjacent to the pressure relief bore 11. It is also possible to design the aperture 12 such that the O-ring 4 is not arranged immediately bordering the pressure relief bore 11.

The ball receiving space 13 is, for all practical purposes, defined by the bearing wall which is generally designated 20; the bearing wall 20 comprises, starting from the inside and moving towards the outside, bearing wall parts 21, 22 and 23. FIG. 2 shows at 40 with a dashed line the aperture 40 adapted to receive the bearing dish means as is shown in FIG. 3.

Generally, the ball receiving space 13 of the piston 1 is limited by a spherical surface 30, a surface which for example can be divided up into three surfaces 41, 44 and 45. The surface 41 extends between the radii 42, 43 (FIG. 2), the surface 44 extends between radius 43 and undercut 25, and the surface 45 extends from the undercut 25 towards the outer end.

Preferably, the bearing dish means 7 is provided at its margin with an end part 8 having a shape which corresponds to the undercut 25. In the embodiment as shown the end part 8 has at its outer perimeter a worked-on shape, i.e., the area 74 which is triangular in cross-section is removed. Due to this design—see FIG. 6—one achieves that the bearing dish means 7 can be kept in the biased condition shown in FIG. 3 and that the required stability of the piston wall (in particular the stability of the bearing wall part 22) is preserved.

In accordance with the invention the method of mounting the bearing dish means 7 as well as the ball 3 proceeds as follows. Firstly, a preformed bearing dish means 7 is pressed by means of a stamp-like tool or die into the ball receiving space 13 as is shown in FIG. 2. This pressing operation occurs such that the bearing dish means is pressed with its outermost marginal area, i.e. the end part 8, into the undercut 25 of the piston 1. This leads to the condition shown in FIG. 3. Secondly, then the ball 3 is inserted, and so as to achieve the finished condition shown in FIG. 4, the outermost bearing wall part 23 is bent around the wall 3 as is shown in FIGS. 4 and 5. During the operation of the machine, the balls 3 running on the multi-lobe cam will be largely supported in the area of the bearing surface 35 of the bearing dish means 7, an area which is designated A in FIG. 3.

FIG. 5 shows an embodiment of a piston without a central relief bore. In this case, the ball runs in the bearing dish means without partial pressure relief like a typical slip bearing. Nothing has to be changed with respect to the bearing dish means and the way it is mounted.

We claim:

1. A piston for a hydraulic piston machine of the multiple displacement type having a rotor, a cam with multiple cam surfaces and axially extending cylinders comprising:

a piston body reciprocating in each of said cylinders whereby when the rotor is rotated relative to the cam the piston reciprocates in said cylinders, said body having a ball receiving space defined at one end thereof and a recess;

a ball in said ball receiving space;

a bearing dish in said piston ball receiving space formed by a steel support layer, a bronze layer cast onto said steel layer and a plastic layer supporting said ball.

2. A piston as in claim 1 wherein said piston body has a bore opening into said space about said recess.

3. A piston as in claim 1 wherein said piston body defines an undercut at the periphery of said space for engaging the periphery of said bearing dish.

4. A piston as in claim 1 wherein said plastic layer is approximately 0.5 mm thick.

5. A piston for a hydraulic piston machine of the multiple displacement type comprising:

a piston body having a ball receiving space defined at one end thereof and a recess;

a ball in said ball receiving space;

a bearing dish in said space supporting said ball; and an O-ring engaging said recess and sealing the bottom surface of said bearing dish.

6. A piston as in claim 5 wherein said piston body has a bore opening into said space about said recess.

7. A piston as in claim 5 wherein said piston body defines an undercut at the periphery of said space for engaging the periphery of said bearing dish.

8. A piston as in claim 5 wherein said plastic layer is approximately 0.5 mm thick.

9. A piston as in claim 5 wherein said dish is formed with a steel support layer, a bronze layer cast onto said steel layer and a plastic layer supporting said ball.

* * * * *